United States Patent [19]

Stephan

[11] Patent Number: 4,577,671

[45] Date of Patent: Mar. 25, 1986

[54] CASTING DECORING DEVICE

[76] Inventor: Mark C. Stephan, 333 S. Hazel St., Upper Sandusky, Ohio 43351

[21] Appl. No.: 623,028

[22] Filed: Jun. 21, 1984

Related U.S. Application Data

[63] Continuation-in-part of Ser. No. 406,349, Aug. 9, 1982, abandoned.

[51] Int. Cl.[4] ..... B22D 29/00

[52] U.S. Cl. ..... 164/401; 164/345

[58] Field of Search ..... 164/404, 401, 344, 345, 164/346, 131, 132; 51/426; 312/250; 248/631; 366/111; 292/201, 240

[56] References Cited

U.S. PATENT DOCUMENTS

| | | | |
|---|---|---|---|
| 1,870,120 | 8/1932 | Humes | 248/631 |
| 1,966,571 | 7/1934 | Webb | 51/426 |
| 2,008,741 | 7/1935 | Allan | 51/426 |
| 2,179,495 | 11/1939 | Court et al. | 292/201 |
| 2,686,991 | 8/1954 | Powell et al. | 51/426 |
| 3,282,542 | 11/1966 | Goodwin et al. | 248/631 |
| 3,298,138 | 1/1967 | McCormick | 51/426 |
| 3,406,997 | 10/1968 | Wilcox | 292/201 |
| 3,891,191 | 6/1975 | Choules et al. | 366/111 |
| 4,153,227 | 5/1979 | Gamaunt | 248/631 |
| 4,185,681 | 1/1980 | Church et al. | 164/404 |
| 4,206,800 | 6/1980 | Pol | 164/401 |

FOREIGN PATENT DOCUMENTS

| | | | |
|---|---|---|---|
| 2067938 | 8/1981 | United Kingdom | 164/344 |
| 328988 | 2/1972 | U.S.S.R. | 164/404 |
| 526446 | 9/1976 | U.S.S.R. | 164/344 |

*Primary Examiner*—Nicholas P. Godici
*Assistant Examiner*—G. M. Reid
*Attorney, Agent, or Firm*—Harpman & Harpman

[57] ABSTRACT

A casting decoring device to decore metal castings by vibration within an enclosure. The enclosure provides a dust and sound isolation of the casting from the environment with the casting held in an isolation fixture within. A time control circuit is provided to cycle the device according to the size and number of castings within to be treated.

3 Claims, 8 Drawing Figures

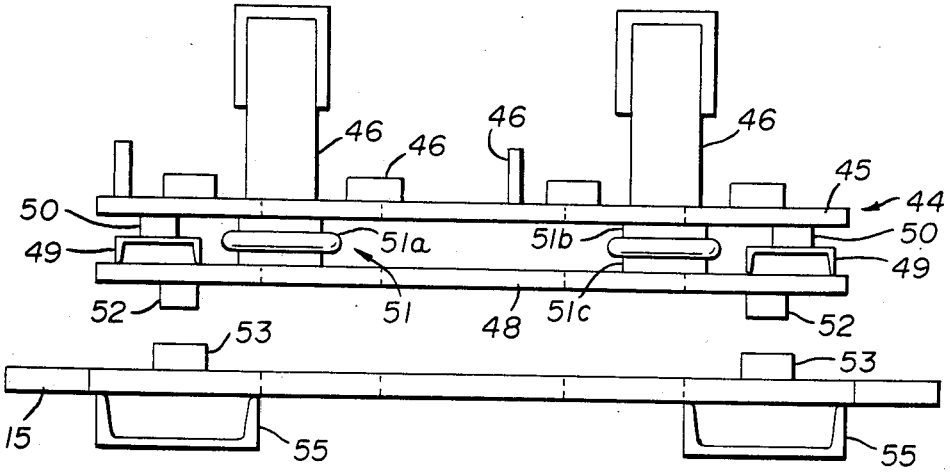
FIG. 3
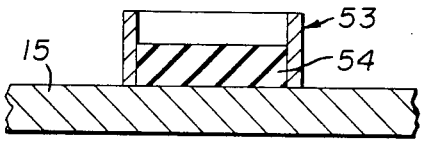
FIG. 4
FIG. 5
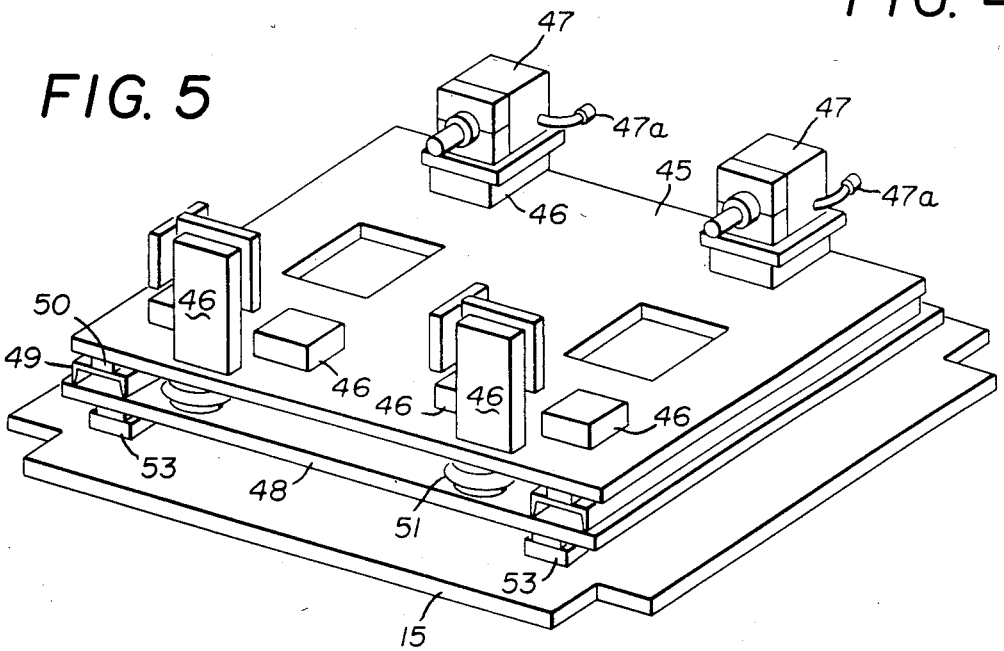

CASTING DECORING DEVICE

This is a continuation in part of Ser. No. 06/406,349, filed Aug. 9, 1982 now abandoned.

BACKGROUND OF THE INVENTION

1. Technical Field

Devices of this type are used to remove a disintegrable core from a metal casting by vibration with air and water blasts. These devices have used a combination of treatments to clean a metal casting of the mold material, such as sand mixed with a binder to help hold the desired shape. The core material is disintegrable allowing complex shapes of the metal casting to be thoroughly cleaned by vibration.

2. Description of the Prior Art

Prior art devices of this type have relied on a variety of different structures to clean the castings. See for example U.S. Pat. Nos. 4,206,800, 2,686,991, 2,008,741, U.K. Pat. No. 2,067,938.

In U.S. Pat. No. 4,206,800, a rotating acoustic sand core shake-out device is disclosed using a plurality of shake out stations which are rotated cycling the cleaning time.

In U.S. Pat. No. 1,966,571, a wet blast apparatus is shown wherein a reservoir is formed for collecting the rinsing liquid dispensed within.

U.S. Pat. No. 2,686,991 discloses a blast cleaning apparatus to clean drums within a cabinet. The device rotates the drum within to expose the surface to the abrasive.

U.K. Pat. No. 2,067,938 discloses a casting core knockabout machine having an enclosure of sound proofing material in which the work piece is positioned. A movable carriage having a hammer is engagable on the work surface.

Applicant's device utilizes a sound and dust isolation enclosure. The work piece is secured to a support fixture within and a predetermined time cycle is actuated.

SUMMARY OF THE INVENTION

A casting decoring device having a single station enclosure that isolates both sound and dust emissions usually associated with decoring operations. The device isolates and holds a number of different work pieces on a single fixture within and processes the same through a predetermined time cycle indicated by a controller associated with the device.

DESCRIPTION OF THE DRAWINGS

FIG. 3 is a front plan view of a mounting fixture within a portion of the device;

FIG. 4 is an enlarged cross sectional view of a fixture supporting guide;

FIG. 5 is a perspective view of the fixture within the casting decoring device;

DESCRIPTION OF THE PREFERRED EMBODIMENT

Figure 1:
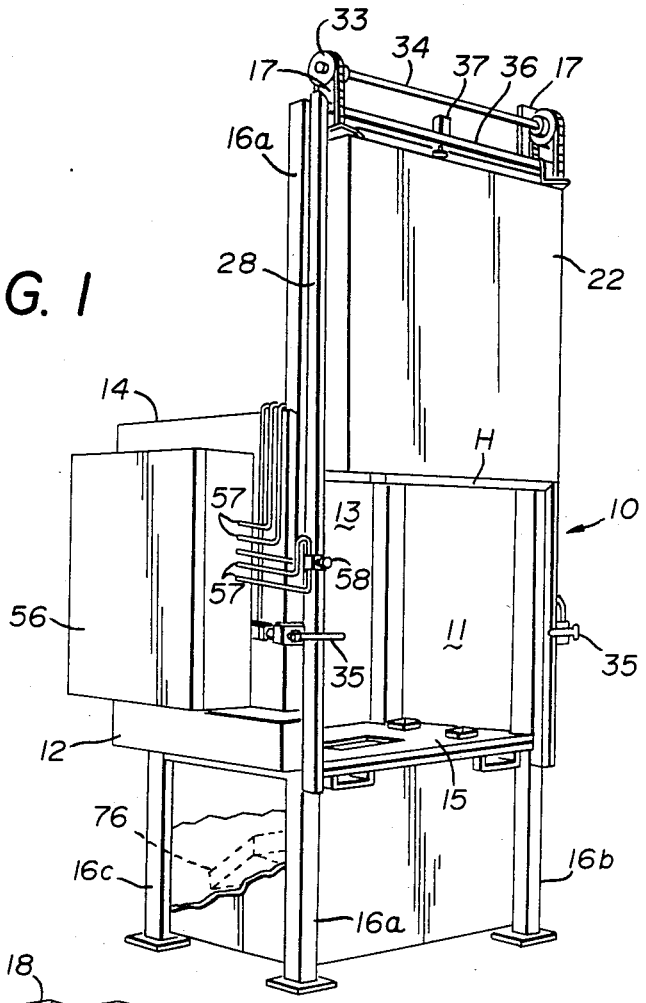
FIG. 1 is a perspective view of the casting decoring device.

A casting decoring device comprising an enclosure 10 having oppositely disposed side walls 11 and 12, a back wall 13, a top 14 and an apertured bottom panel 15. A plurality of tubular legs 16A, 16B, 16C, and 16D extend from within the enclosure 10 outwardly through the bottom panel 15 supporting the same in an elevated manner. The legs 16A and 16B also extend upwardly above the enclosure 10 and each have an axle support bracket 17 secured to their free ends.

Figure 2:
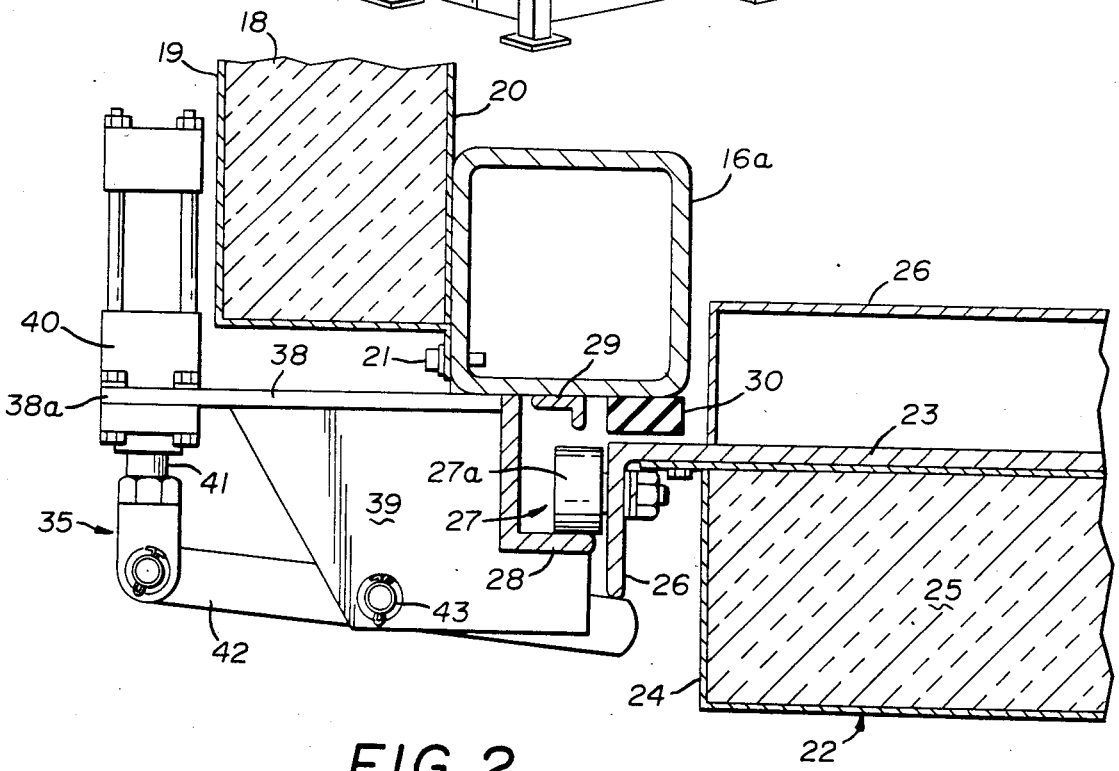
FIG. 2 is an enlarged cross sectional view of a portion of the casting decoring device.

The side walls 11 and 12 and the top 14 are all formed with sound absorbing insulation 18 enclosed between an outer surface 19 and an inner surface 20 as best seen in FIG. 2 of the drawings. Each of the side walls 11 and 12 and back wall 13 are secured to the tubular legs 16A, 16B, 16C, and 16D by a plurality of fasteners 21.

A door 22 has a main support frame member 23 with a sound isolation panel 24 secured thereto. The isolation panel 24 is filled with sound absorbent material 25 as best seen in FIG. 2 of the drawings. A secondary panel 26 is secured to the opposite side of said main support frame 23 and may also be filled with sound absorbing material. The main support frame member 23 has right angularly disposed vertical edges 26 which are adapted to receive each, a roller assembly 27 having a roller 27A thereon. A vertically extending L-shaped guide track 28 is secured to each of the tubular support legs 16A and 16B extending from the bottom panel 15 to the free end of said legs 16A and 16B.

Figure 6:
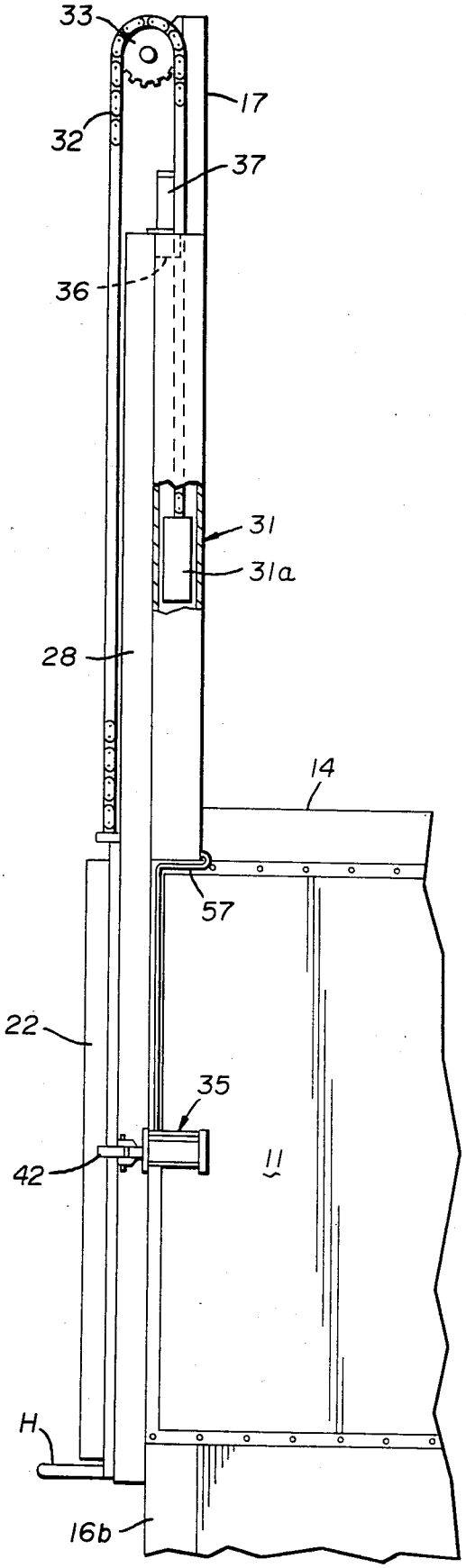
FIG. 6 is a portion of side elevation with a portion broken away of the casting decoring device.
Figure 5A:
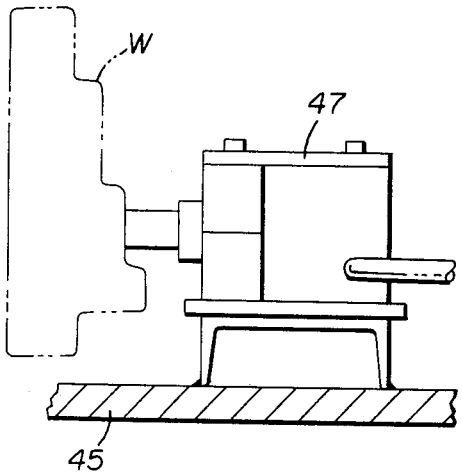
FIG. 5A is an enlarged view of a portion of a work piece and vibrating mechanism of the fixture.

A secondary guide track 29 is secured in spaced relation to the guide track 28 on the tubular legs 16A and 16B. The rollers 27A are registrable between the guide tracks 28 and secondary guide tracks 29, the latter of which restricts the lateral movement of the door 22 towards and away from the enclosure 10. A gasket 30 extends around the perimeter of the enclosure adjacent the opening in sealing relation with the door 22 when in closed position as seen in FIG. 6 of the drawings. The door 22 has a counter weight assembly 31 comprising a weight 31A with chains 32 extending therefrom to the door 22 over a pair of spaced sprockets 33 on a shaft 34 rotatably secured to the axle support bracket 17.

A pair of oppositely disposed pneumatic door clamps 35 are secured to the legs 16A and 16B so as to be engageable on the door as seen in FIGS. 2 and 6 of the drawings. A cross support bar 36 extends between the legs 16A and 16B from their free ends and supports a shock absorber 37 therebetween for engagement with the door 22 when in fully opened position. The pneumatic door clamps 35 are comprised of a mounting bracket 38 having an apertured free end 38A and a pivot support brace 39 extending outwardly at right angles therefrom. The pneumatic piston and cylinder assembly 40 is mounted to the apertured free end 38A with a piston 41 pivotally secured to a clamp arm 42 which is in turn pivoted to the pivot support brace 39 at 43. The opposite end of the clamp arm 42 is engagable on the right angular disposed vertical edges 26 upon activation of said piston and cylinder assembly 35 affectively sealing the door 22 against the gasket 30.

Referring now to FIGS. 3, 4, 5, and 5A of the drawings, a support fixture 44 can be seen comprising an apertured flat base member 45 with a variety of vertically upstanding work piece engagement brackets 46 and a pair of pneumatic guns 47 secured thereto. It will be evident to those skilled in the art that the placement of the engagement brackets 46 will vary depending on the work piece to be held and that the positioning of the pneumatic guns 47 will also be a matter of choice suited to the particular requirements of the user. An isolator support plate 48 is positioned directly under said fixture 44 and has a pair of oppositely disposed inverted U-shaped brackets 49 extending longitudinally along each edge.

Base member engagement members 50 extend from said brackets 49 stabilizing the fixture 44 which is supported in spaced relation to said isolation plate 48 by a number of isolation members 51. Each of said isolation members 51 is comprised of a multiple layered configuration having an inflatable isolation bag 51A positioned between two supporting members 51B and 51C. The isolation support plate 48 has a number of widely spaced support feet 52 which in turn are registrable within an equal number of locator wells 53 having an inner diameter greater than that of said support feet 52 and which are located on the bottom panel 15 with a resilient rubberized pad 54 within each of the locator wells as best seen in FIG. 4 of the drawings. The bottom panel 15 has a pair of oppositely disposed U-shaped members 55 registrable with a fork lift (not shown) for transport of the casting decoring device.

Referring now to FIG. 1 of the drawings, a control box 56 can be seen secured to the side wall 12 with a plurality of supply lines 57 extending therefrom and communicating with the door clamps 35, the isolation bags 51A, the pneumatic guns 47 via fittings 47A and an on-off switch 58.

Figure 7:
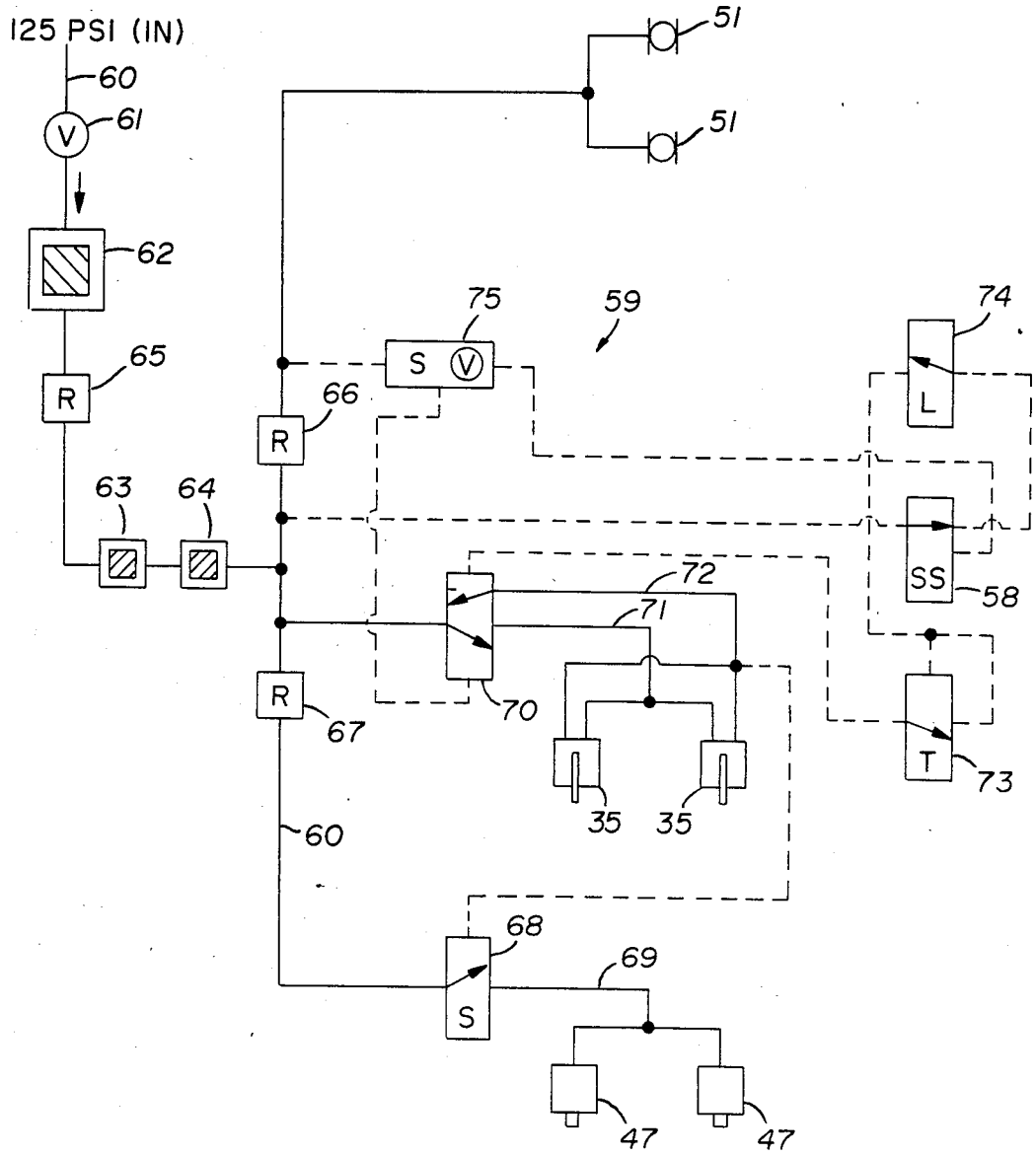
FIG. 7 is a schematic diagram of the control circuitry of the device.

In FIG. 7 of the drawings, a control system 59 can be seen having a supply pressure inlet line 60 with a main system control valve 61, a plurality of in line filters 62, 63 and 64 and regulators 65, 66, and 67 to reduce the line pressure and condition the control fluid as will be well understood by those skilled in the art.

A pilot control switch 68 on the inlet line 60 controls the pneumatic guns 47 via a supply line 69 while a secondary pilot control switch 70 controls the door clamps 35 via supply lines 71 and 72. The on-off switch 58, a system timer 73, a limit valve 74 and a shuttle valve 75 complete the major control components of the pilot control of the system.

In operation, the door 22 is raised by a handle H and the fixture 44 with the work pieces W positioned thereon is set into the enclosure 10. The supply lines 57 are connected as hereinbefore described and the door 22 is closed. The pilot control system acuates the door clamps 35 via the secondary pilot control switch 70 which in turn activates the pneumatic guns 47 via the pilot control switch 68. The timer 73 controls the overall cycle of the system which is predetermined based on the number and type of workpieces W on the fixture 44. The on-off switch 58 gives the operator overall control of the pilot control system as will be evident from the above description.

Referring again to FIG. 1 of the drawings, a disposal chute 76 can be seen in broken lines in which the sand and binder freed from the work piece passes out of the casting decoring device as it falls through the aperture in the base panel 15.

It will thus be seen that a casting and decoring device has been illustrated and described that provides a single station operation that reduces the noise and dust associated with such decoring operations in the past and provides a controlled time cycle for the effective treatment of the work pieces within a removable isolation fixture.

It will be evident from the foregoing description by those skilled in the art that various changes and modifications may be made herein without departing from the spirit of the invention and having thus described my invention what I claim is:

1. A casting decoring device comprising in combination an enclosure having side walls, a top and apertured bottom, a door on said enclosure having a main support frame with a sound isolation panel secured thereto and a plurality of roller assemblies thereon, means for soundproofing said enclosure, a door guide means on said enclosure, a pair of door clamps comprising pneumatic piston and cylinder assemblies selectively activated mounted on said enclosure movably engaging said door assembly in sealing relation to said enclosure, a support fixture removably positioned within said enclosure, isolation means on said support fixture isolating said fixture from said apertured bottom, said isolation means comprising isolation bags positioned between an isolation support plate and said support fixture, a plurality of locator wells on said apertured bottom aligned with support feet extending from said isolation support plate, a pneumatic gun removably secured on said support fixture, means for centrally controlling said pneumatic gun and said door clamps in an interdependent controlled cycle.

2. The casting decoring device of claim 1 wherein said door guide means comprises guide tracks secured to said means for supporting said enclosure and a counter weight in communication with said door assembly.

3. The casting decoring device of claim 1 wherein said central control means comprises a control system having an inlet supply line, a plurality of line filters and pressure regulators, pilot control switches, an on/off switch, a timer and pilot control and supply lines interconnecting the same.

* * * * *